US007863558B2

(12) United States Patent
Schneider et al.

(10) Patent No.: US 7,863,558 B2
(45) Date of Patent: Jan. 4, 2011

(54) RADIO FREQUENCY ION GUIDE

(75) Inventors: Bradley B. Schneider, Bradford (CA); Thomas R. Covey, Richmond Hill (CA)

(73) Assignee: DH Technologies Development PTE. Ltd., Singapore (SG)

( * ) Notice: Subject to any disclaimer, the term of this patent is extended or adjusted under 35 U.S.C. 154(b) by 268 days.

(21) Appl. No.: 11/703,756

(22) Filed: Feb. 8, 2007

(65) Prior Publication Data

US 2007/0187614 A1 Aug. 16, 2007

Related U.S. Application Data

(60) Provisional application No. 60/771,115, filed on Feb. 8, 2006.

(51) Int. Cl.
*H01J 49/04* (2006.01)

(52) U.S. Cl. ..... 250/282; 250/281; 250/292

(58) Field of Classification Search ..... 250/396 R, 250/281, 289, 288, 299, 282, 283, 290, 291, 250/292, 293

See application file for complete search history.

(56) References Cited

U.S. PATENT DOCUMENTS 6,392,225 B1 * 5/2002 Schwartz et al. ..... 250/292
6,528,784 B1 * 3/2003 Tang et al.
6,639,213 B2 * 10/2003 Gillig et al.
6,707,037 B2 * 3/2004 Whitehouse
6,723,986 B2 * 4/2004 Kernan et al.
6,812,453 B2 * 11/2004 Bateman et al.
6,897,437 B2 * 5/2005 Fuhrer et al.
6,992,284 B2 * 1/2006 Schultz et al.
2001/0032929 A1 * 10/2001 Fuhrer et al. ..... 250/281
2001/0032930 A1 * 10/2001 Gillig et al. ..... 250/288
2003/0080290 A1 * 5/2003 Baranov et al. ..... 250/288
2003/0160168 A1 * 8/2003 Speakman et al. ..... 250/288
2003/0178564 A1 * 9/2003 Kernan et al. ..... 250/292
2004/0026610 A1 * 2/2004 Abou-Shakra et al. ..... 250/281
2004/0178342 A1 * 9/2004 Kernan et al. ..... 250/292
2004/0251411 A1 * 12/2004 Bateman et al. ..... 250/293
2005/0151074 A1 * 7/2005 Thakur ..... 250/288
2006/0289747 A1 * 12/2006 Schultz et al. ..... 250/294

* cited by examiner

*Primary Examiner*—Jack I Berman
*Assistant Examiner*—Nicole Ippolito Rausch
(74) *Attorney, Agent, or Firm*—Bereskin & Parr LLP/S.E.N.C.R.L., s.r.l.

(57) ABSTRACT

An ion guide with two or more ion focusing elements and a gas channeling sleeve is described. An ion transport space within the gas channeling sleeve is in fluid communication with a pumping port. A suction device is used to suction gas out of the ion transport space through the pumping port establishing a gas flow. Ions in the ion transport space are transported from an ion entry end to an ion exit end of the ion guide by the gas flow. Several examples include a multipole ion guide in which rods are used as ion focusing elements. The gas channeling sleeve is fitted about the rods. In another example, toroidal or ring shaped ion focusing elements are used as ion focusing elements. In another example, a set of ion focusing rings are mounted between insulators to form a cylinder with a gas impermeable side wall. The cylinder is itself used as the gas channeling sleeve.

20 Claims, 8 Drawing Sheets

RADIO FREQUENCY ION GUIDE

FIELD

This disclosure relates to ion guides. More particularly, the disclosure relates to radio-frequency (RF) ion guides used to transport ions.

BACKGROUND

Ion guides are used in spectrometers and other devices to transport ions and for other purposes. Ions are provided using an ion source. For most atmospheric pressure ion sources, ions pass through an aperture or skimmer prior to entering the ion guide at an ion entry end. A radio frequency signal may be applied to the ion guide to provide radial focusing of ions within the ion guide. As a result, the transport efficiency through an ion guide can be very high.

Some ion sources, including matrix assisted laser desorption/ionization (MALDI), surface enhanced laser desorption/ionization (SELDI) and other ion sources are capable of generating ions in lower pressure regions. When such an ion source is used with an ion guide, the ion source may be positioned adjacent to the ion entry end of the multipole such that the ion generation region and the multipole are maintained at the same pressure. Some of the ions generated from the ion source enter the ion guide. When there is little or no pressure differential between the source and the ion guide, ions are typically propelled along the length of the ion guide by space charge repulsion between the ions that have the same polarity. As new ions are generated during a particular experiment and enter the ion guide, previously generated ions are propelled along the length of the ion guide by space charge repulsion. While space charge effects will propel ions through an ion guide, they can lead to a number of undesirable effects. For instance, the extent of the axial force on an ion depends on both the number and proximity of other ions of the same polarity. As a result, the transport of the ions through the ion guide is inconsistent and slow when space charge is the dominant driving force. For MALDI quantitation experiments, where samples can be ablated to depletion on the target, ion liberation rates from samples are initially high and then drop off to zero over the course of an experiment. Therefore, the space charge force is strong initially, and subsequently drops off such that ions generated near the end of the experiments are more weakly propelled through the ion guide. This can lead to broad and variable peak shapes, unsuitable for high throughput quantitation. In addition, since space charge forces are essentially non-directional, ion losses are expected to be greater when they comprise the most significant driving force for ion motion in the axial direction.

It is desirable to provide an ion guide with a more efficient ion transport mechanism than previous devices to more efficiently and reproducibly transport ions along the length of an ion guide.

SUMMARY

In one example according to a first aspect, the applicant's teachings provide a method of transporting ions in an ion guide having an ion entry end and an ion exit end. The method comprises providing an ion focusing field within the ion guide and generating a gas flow along at least part of a length of the ion focusing field, including a region adjacent the ion exit end.

In another example of this aspect, the ion guide is a multipole ion guide having at least two poles and wherein the ion focusing field is provided by applying radio frequency signals to the poles.

In another example of this aspect, the ion focusing field is generated along an axis of the ion guide and wherein the gas flow is provided at least in part along the axis.

In another example of this aspect, the gas flow is generated by positioning a sleeve about the poles and suctioning gas through the sleeve.

In another example of this aspect, the ion guide is formed of a plurality of conductive rings separated by interspersed insulators, wherein each insulator is sealed against adjacent rings and wherein the gas flow is generated by suctioning gas through the rings and the insulators.

In another example of this aspect, the ion guide is comprised of a plurality of rings spaced apart from one another and wherein the gas flow is generated by positioning a sleeve about the rings and suctioning gas through the sleeve.

In another example of this aspect, the generally balanced axial field is produced by applying a first RF signal to the first pole and a second RF signal to the second pole wherein the first and second RF signals have an approximately equal magnitude but are 180° out of phase with one another.

In another example of this aspect, the method comprises producing ions from an ion source positioned adjacent an ion entry end of the ion guide and wherein the produced ions are transported from the ion entry end of the multipole assembly towards and ion exit end of the ion guide by the gas flow.

In another example of this aspect, an additional the gas flow is generated through the ion entry end of the ion guide. Optionally, the additional gas flow may be restricted adjacent the ion entry end.

In another example of this aspect, the gas flow begins adjacent the ion entry end and continues through the ion exit end of the ion guide. Optionally, the gas flow may be restricted adjacent the ion entry end using a lens or other restrictive element.

An example of another aspect of the applicants teaching, provides an ion guide comprising: a plurality of ion focusing elements positioned about an axis; and a sleeve for channeling a gas flow along at least a portion of the axis.

In another example of this aspect, the ion focusing elements include a first pole and a second pole, wherein the first pole includes at least two first pole rods and the second pole includes at least two second pole rods, and wherein the sleeve is positioned about the first and second pole rods.

In another example of this aspect, the ion guide has an ion entry end and an ion exit end wherein the sleeve extends between the ion entry end and the ion exit end.

In another example of this aspect, the ion guide comprises a sleeve cap mounted to the sleeve adjacent the ion entry end and wherein the sleeve cap has a cap aperture aligned with the axis.

In another example of this aspect, the ion focusing elements include a plurality of rings separated by insulators, wherein the rings and insulators together form the sleeve.

In another example of this aspect, the ion focusing elements include a plurality of rings positioned about the axis and positioned within the sleeve.

An example of another aspect of the applicant's teaching provides an ion guide assembly having an ion entry end and an ion exit end comprising: a plurality of ion focusing elements positioned about an axis; a sleeve for channeling a gas flow along at least a portion of the axis; and a suction device for suctioning gas through the sleeve.

In another example of this aspect, the ion guide assembly comprises a sleeve cap mounted on the sleeve adjacent the ion entry end.

In another example of this aspect, the ion guide is located within a differentially pumped region of a mass spectrometer such that an additional gas flow is generated into the ion guide inlet as a result of the pressure differential between the 2 vacuum stages.

These and other aspects of the applicant's teaching are described in greater detail below.

BRIEF DESCRIPTION OF THE DRAWINGS

Several examples will now be described in detail with reference to the drawings, in similar elements are identified by similar reference numerals and in which.

DESCRIPTION OF EXAMPLES

Figure 1:
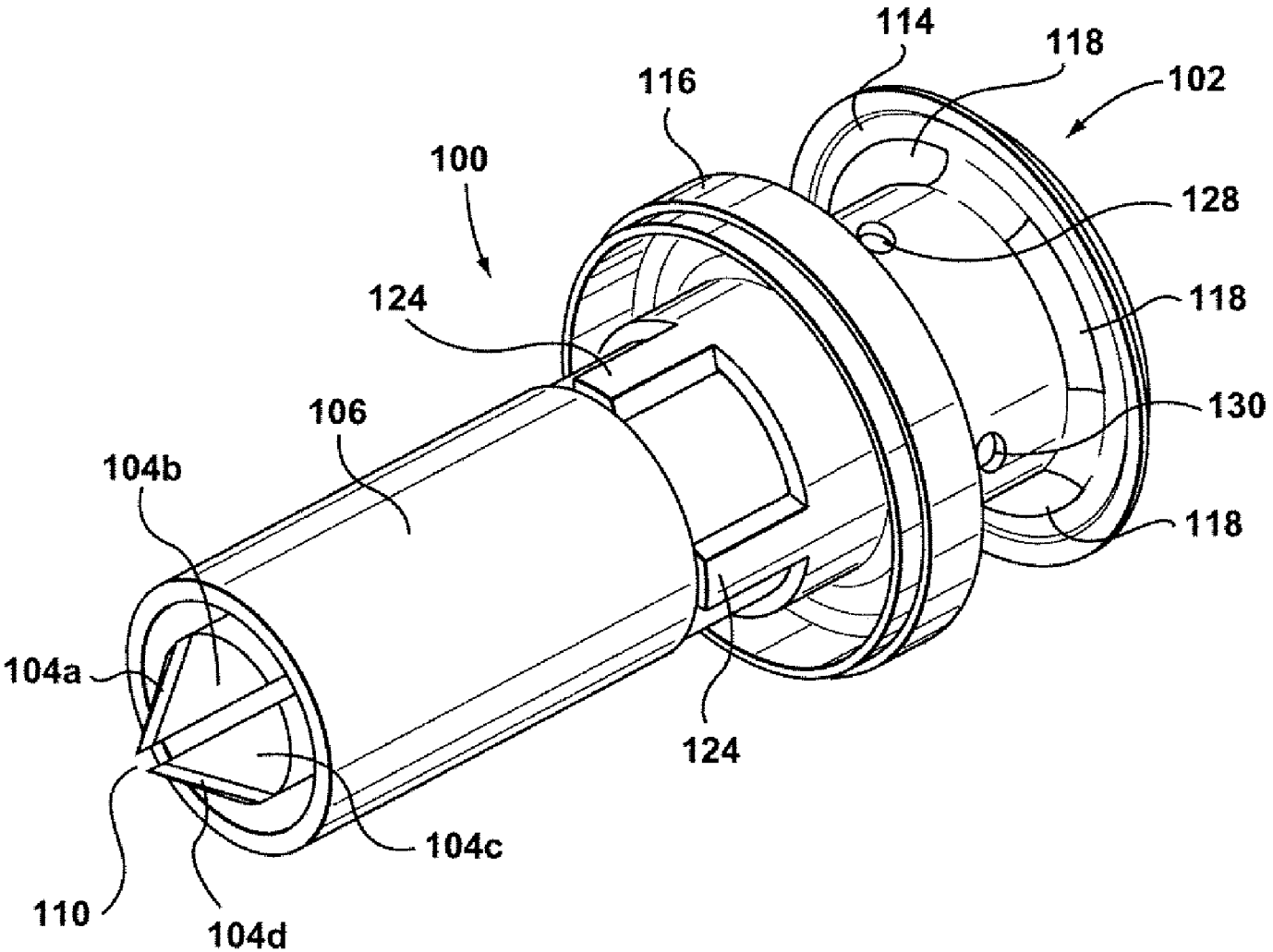
FIG. 1 is a perspective view of a first example ion guide.
Figure 2:
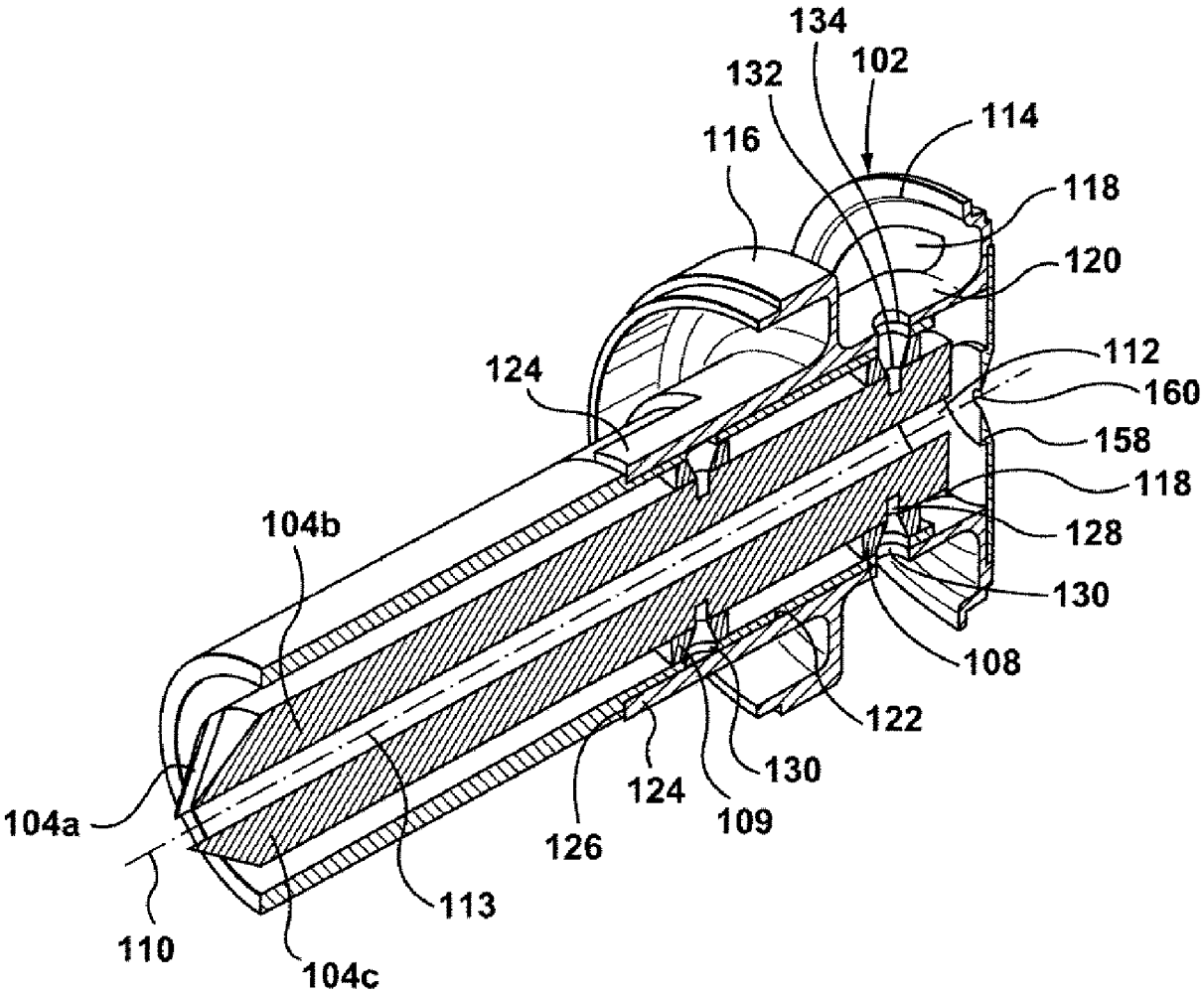
FIG. 2 is a perspective cross-sectional view first example ion guide.

Reference is first made to FIGS. 1 and 2, which illustrate a first example ion guide 100. Ion guide 100 comprises a mounting bracket 102, four rods 104*a-d*, a gas channeling sleeve 106 and a pair of insulators 108 and 109. Ion guide 100 has an ion entry end 110 and an ion exit end 112.

Mounting bracket 102 has a base flange 114 and a barrier flange 116. In the present example, base flange 114 and barrier flange 116 are formed integrally with mounting bracket 102 and are separated by a sleeve support 120. Sleeve support 120 has a generally cylindrical inner wall 122.

Sleeve support 120 includes a plurality of sleeve positioning arms 124. Sleeve 106 is positioned within Sleeve support 120 and is fitted within the inner wall 122. Sleeve 106 has a detent 126 formed around its outer circumference. Detent 126 rests against the sleeve positioning arms 124, such that sleeve 106 is spaced apart from the base flange 114 at the ion exit end 112 of the ion guide 100. Detent 126 ensures proper positioning of the sleeve 106 and the rods 104*a-d* relative to the base flange. Sleeve 106 is secured in place using a set screw (not shown). The set screw is screwed through a tapped aperture in sleeve support 120 and engages the sleeve. A skilled person will understand the use of a set screw to retain sleeve 106 in a fixed position relative to bracket 102.

Sleeve 106 has a circular cross-section (when viewed in the X-Y plane), corresponding to the cross-section of inner wall 122, allowing the sleeve 106 to nest within sleeve support 120 and is centered about an ion guide axis 113. Sleeve 106 surrounds the rods 104.

In another examplary ion guide, the sleeve may be mounted within or to the support bracket in another manner without the use of a detent or supporting arms to position the sleeve. For example, the sleeve may be fastened into a particular position within the support bracket. In another embodiment, the sleeve may be fastened into mounting points on the bracket and the sleeve and bracket may not have a friction fit mount. In other embodiments, the sleeve may be mounted around a multipole in any manner suitable to the embodiment.

Insulators 108 and 109 are mounted within sleeve 106. Insulators 108 and 109 have a series of fastening apertures 128 passing through them that are shaped to accept fastening screws 130. Mounting bracket 102 and sleeve 106 have corresponding apertures 132 and 134 that allow the fastening apertures 128 to be accessed. Rods 104 are mounted to insulators 108 and 109 using screws 130. Rods 104 are tapped to receive screws 130. Insulators 108 and 109 are not electrically conductive and serve to electrically isolate the rods 104 from one another.

In the present example, insulators 108 and 109 are held in place in sleeve 106 by friction. In another exemplary ion guide, insulators 108 and 109 may be fixed to inner surface of the sleeve 106 using a fastener such as a screw, bolt or an adhesive.

The rods 104*a-d* form a quadrupole and operate as ion focusing elements. Other ion guides utilizing a gas channeling sleeve may include more than four rods. The rods in such examples, and in the present example, form a multipole. Rods 104 are positioned equidistantly from and parallel to multipole axis 113 in this example, but may be mounted in any means known in the art. Rods 104*a* and 104*c* are positioned opposite one another about axis 113 and define an X axis. Similarly, rods 104*b* and 104*d* are positioned opposite one another about axis 113 and define a Y axis that is perpendicular to the X axis. A Z axis is defined normal to both the X and Y axes. The axis 113 lies on the Z axis. In this example, the rods 104 have a circular cross section and each rod has an axis. The axes of the rods 104 define a square when viewed on a cross section taken normal to the Z axis.

Rods 104 have a circular cross section. The present disclosure is not limited to use with cylindrical rods and may be used with rods of any cross section, such as parabolic, square or hyperbolic rods.

Rods 104*a* and 104*c* are electrically coupled together and together form an X-pole (The coupling is not illustrated in the drawings. In one example, an electrical connector is installed between one of the screws 130 used to mount each rod and the connectors are coupled with a wire to couple the rods.) Rods 104*b* and 104*d* are electrically coupled together to form a Y-pole.

The X-pole and Y-pole are coupled to an RF signal source (not shown), which applies RF signals to the poles. The RF signals are configured to provide an ion focusing field along the length of the ion guide. The RF signals may be of equal magnitude but 180° out of phase to the poles to provide a balanced RF field along the axis 113 of the quadrupole. Alternatively, unbalanced RF signals may be applied to the poles.

Bracket 102 is made of a gas impermeable material. In the present example, bracket 102 is made of stainless steel. In other examples, it could be made from another metal or another gas impermeable material such as plastic or nylon. Bracket 102 has a plurality of apertures 118 adjacent to the base flange 114. An exit plate 158 is mounted to the bracket 102 adjacent the ion exit end 112 of the ion guide. Exit plate 158 has an ion exit aperture 160 through which ions can exit the ion guide 100. Ion exit aperture 160 is centered about axis 113.

Figure 3:
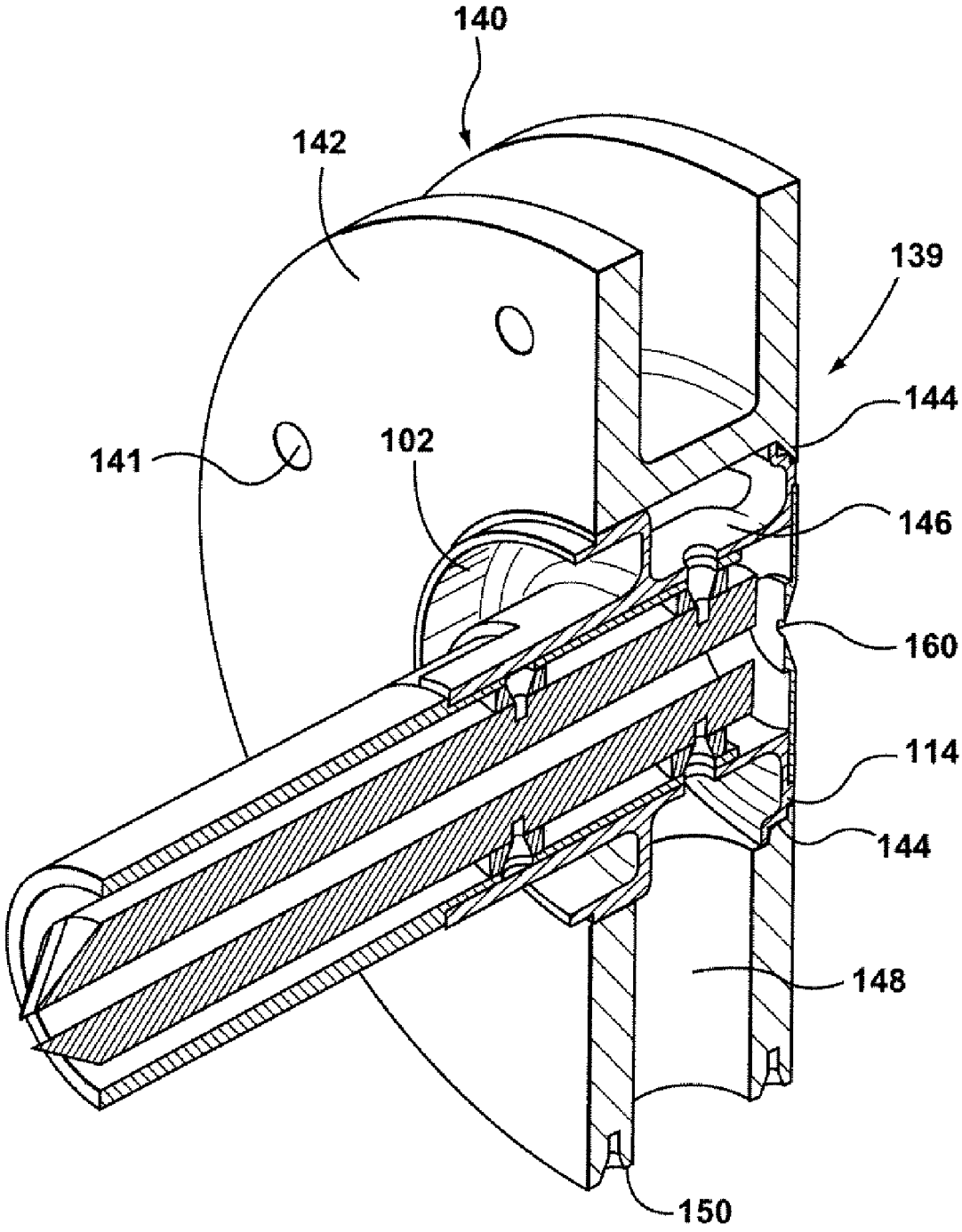
FIG. 3 is a perspective cross-sectional view of the first ion guide assembly.

Reference is made to FIG. 3, which illustrates ion guide 100 mounted within a housing 140 to form an ion guide assembly 139. Housing 140 has a mounting flange 142 that may be used to mount the housing 140 within or to an ion source or an ion processing device such as a mass spectrometer (or both) using mounting apertures 141. Housing 140 also has an ion guide seat flange 144, an ion guide chamber 146, a pumping port 148 and a pump mounting flange 150. Ion guide 100 is inserted into the ion guide chamber 146 and base flange 114 is positioned against seat flange 144. An o-ring (not shown) made from suitable materials such as Viton may be used to achieve a vacuum seal. Ion guide chamber 146 has a circular cross section and is sized to receive the mounting bracket 102 of the ion guide.

Pump flange 150 is adapted to receive a gas tube 153 (FIG. 4) which is connected to a roughing pump 154 (FIG. 4) or another suction device that may be used to suction gas from the pumping port. Alternatively, a suction device may be coupled directly to the pump flange 150. In the present example, a gas tube 153 is coupled to the pump flange 150 using a plurality of screws. In other embodiments, any other fastening device such as screws, clips, adhesives, hose clamps, or an interference mount may be used to mount a roughing pump or other suction device.

The volume of space contained within the sleeve extending from the ion entry end 110 to the ion exit end 112 of the ion guide, in which the rods 104 are positioned may be referred to as an ion transport space 156. Apertures 118 connect the ion transport space 156 and the ion guide chamber 146 so that gas can flow between them. The pumping port 148 is connected to the ion guide chamber 146.

When roughing pump 154 is mounted to the housing 140 and activated, it suctions gas within the pumping port 146 out of the ion guide assembly, creating a gas flow 157 beginning at the ion entry end 110, passing through the ion exit end 112, apertures 118, ion guide chamber 146, pumping port 148 and out of the ion guide assembly through the roughing pump. Along the length of the ion guide 100, the gas flow 157 enhances ion transport from the ion entry end 110 to the ion exit end 112. Ions do not follow the gas flow 157 beyond the ion exit end 112 as they are focused by the RF fields applied to rods 104. Ions continue their motion along axis 113 and exit the ion guide through the ion exit aperture 160.

Figure 4:
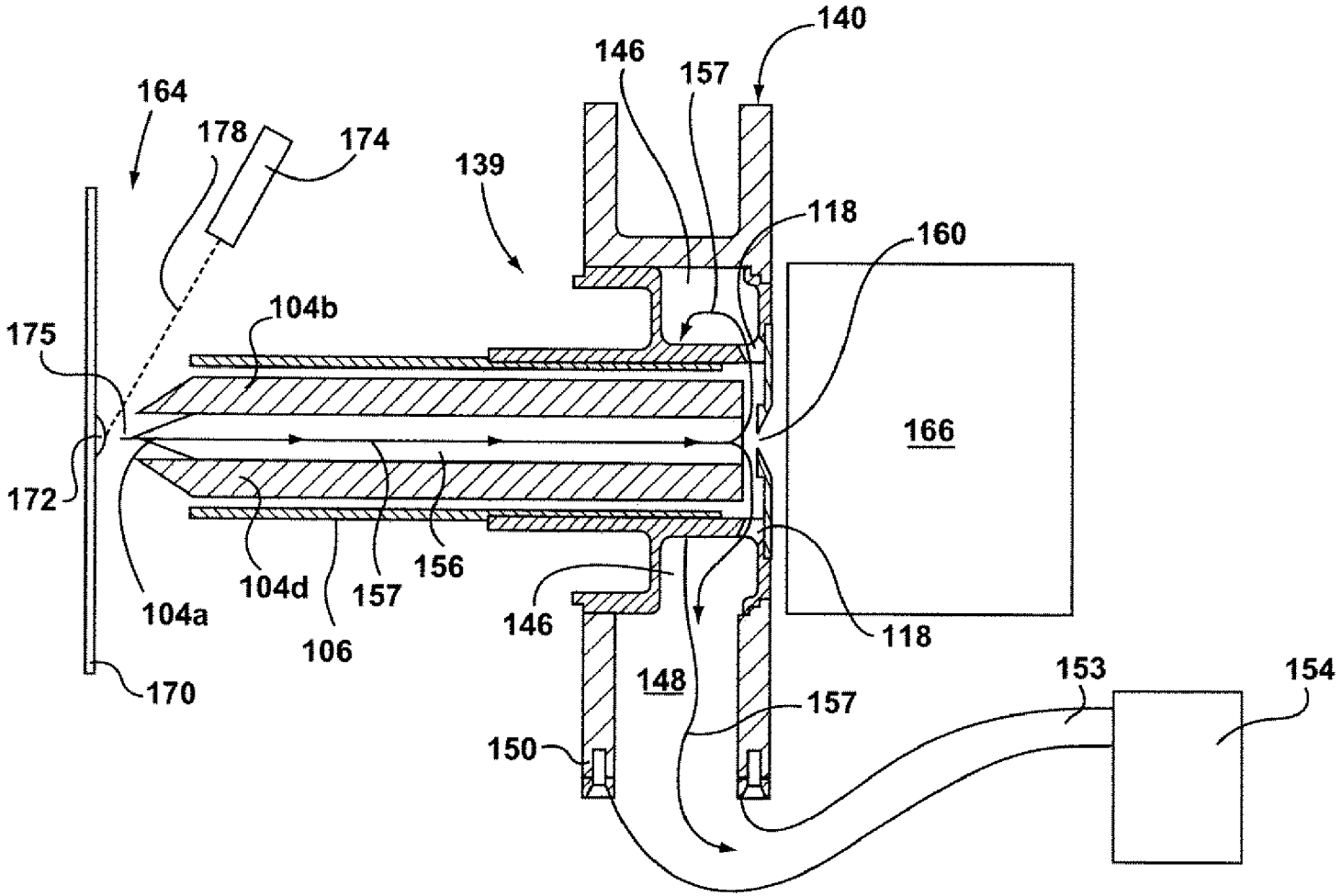
FIG. 4 is a cross sectional side elevation of the first ion guide assembly in use.

Reference is made to FIG. 4, which illustrates ion guide assembly 139 in use with a MALDI (matrix assisted laser desorption/ionization) ion source 164 and an ion processing device 166. MALDI ion source 164 has a sample plate 170, a matrix-solution 172 and a laser 174. A sample containing molecules to be ionized and transported through the multipole assembly 139 is combined with a matrix base. The solution of the sample and matrix are mixed to form a matrix-solution 172, which is then deposited onto the sample plate where they co-crystalize. Alternatively, samples may be deposited onto suitable surfaces with no need for the matrix base.

An ion processing device 166 is mounted adjacent the ion exit aperture 160 in base flange 114. Ion processing device 166 may be any type of ion analyzing or processing device, such as an ion detector, a mass analyzer (which may include an ion detector) or any combination of ion selection, ion processing or ion detection stages.

The multipole assembly 139 is used as follows.

The RF signal source is activated to apply RF signals to the X-pole and the Y-pole. The RF signals applied will typically create a focusing field along the mulitpole axis 113.

The roughing pump 154 is activated to provide gas flow 157. The RF signal source and roughing pump 154 may remain in operation between experiments. Individual experiments are conducted after the signal source and roughing pump have been activated as follows.

To conduct an individual experiment, laser 174 is activated. When laser 174 is activated, it projects a laser beam 178 onto the matrix-solution 172. The sample within matrix-solution 172 is ionized and ions originating from the sample begin to flow into the multipole assembly at the ion entry end 110. The flow of ions from the target plate to the multipole assembly is aided by the application of electric fields between the plate and the inlet. The flow of ions through the ion transport space 122 is due in part to the space charge repulsion described above and is enhanced by the gas flow 157.

The RF signals applied to the X-pole and the Y-pole focus at least some of the ions entering the multipole assembly radially along the multipole axis. These focused ions are drawn along the length of the ion guide 100 to the ion exit end 112 and are ejected into ion processing device 166.

A series of experiments may be conducted by repeatedly activating and de-activating the laser 174 and/or moving the sample plate.

Figure 5:
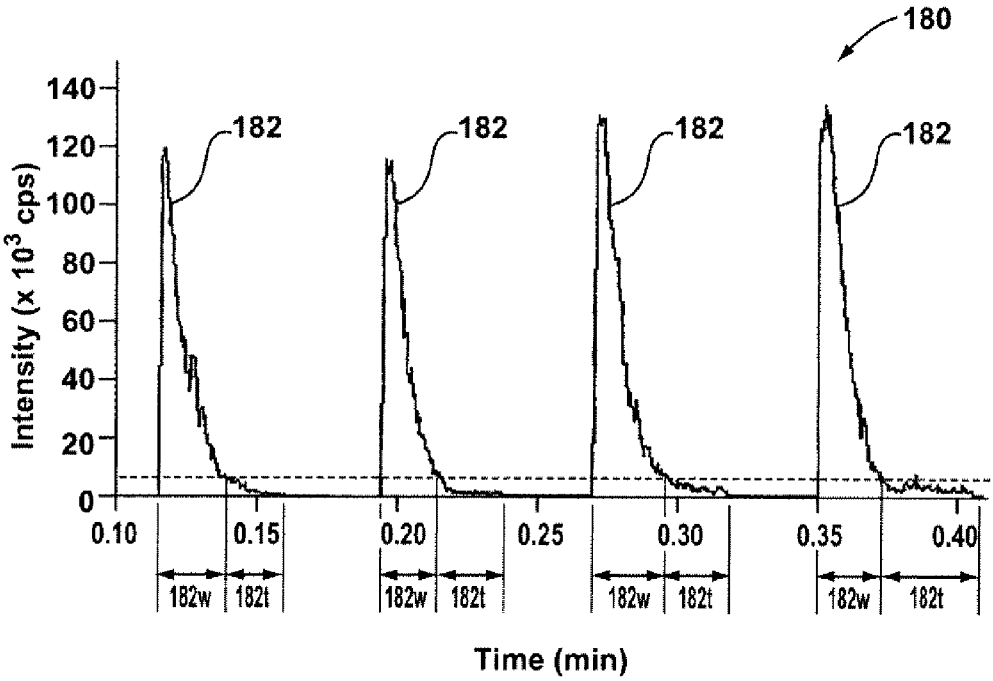
FIG. 5 is an example mass spectrum produced using the first example ion guide assembly.

Reference is next made to FIG. 5, which illustrates a mass spectrum 180 produced using the configuration of FIG. 4 with a mass spectrometer used as the ion processing device 166. The mass spectrometer includes an ion detector and for this example, it is operated in the selected reaction monitoring mode of operation. Ions that reach the detector are counted and mass spectrum 180 plots the ions counted per second (cps) by the ion detector over time. The mass spectrometer may include collision cells, or various ions selection stages to permit only selected ions to be transported through such stages. Ions reach the ion detector if they are selected in the mass spectrometer, allowing specific ions to be selected and counted. Optionally, a DC offset may be applied to the MALDI sample plate 170 or to the rods 104, or both to enhance the entry of ions into the ion transport space.

Mass spectrum 180 illustrates the count of haloperidol fragment ions reaching the ion detector over time during several consecutive experiments. A sample of haloperidol was mixed with the matrix base to form matrix-solution 172. The multipole assembly 100 was activated by activating the RF signal source and the roughing pump 154. Each test is conducted by activating the laser 174 for a time and then de-activating the laser.

Four peaks 182 corresponding to data generated for discrete samples of haloperidol were generated within approximately 0.3 min as shown in mass spectrum 180. Each of the peaks has a peak width 182*w* (defined for the present purpose as the period from the beginning of the peak until the ion count per second falls below 5000). In addition, each peak has a tail 182*t* (defined as the period after the ion count per second falls below 5000 until the ion count falls back to zero).

Figure 6:
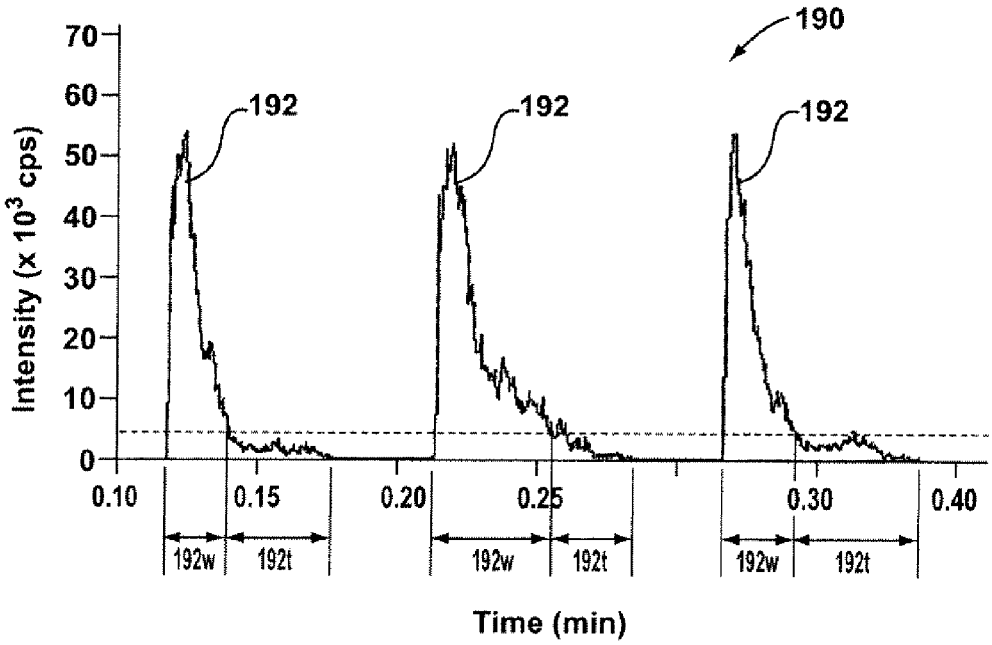
FIG. 6 is an example mass spectrum produced using a prior art ion guide.

Reference is next made to FIG. 6, which illustrates a mass spectrum 190 produced using a previously known ion transport multipole assembly (not shown), which does not include a sleeve. The prior art multipole assembly includes a roughing pump to reduce the pressure within the multipole assembly. The prior art multipole assembly also includes a signal source to apply RF signals to the poles of the multipole. Three peaks 192 of the counts of ions corresponding to haloperidol fragments are shown in mass spectrum 190 as acquired over the same time frame.

To produce mass spectra 180 and 190, laser 174 was activated for the same period of time at the beginning of each test. Successive tests were started when the ions from the preceding test were no longer being counted by the ion detector.

Referring to FIGS. 5 and 6 together, mass spectra 180 and 190 can be compared. Peaks 192 in mass spectrum 190 have a wider peak width 192*w* than the peak widths 182*w* of peaks 182 in mass spectrum 180. The tails 192*t* of the peaks in mass spectrum 190 are also longer than the tails 182*t* of the peaks in mass spectrum 180. The total length of the peaks (combining the peak width with the tail width) is considerably shorter for peaks 182 than for peaks 192. The heights of peaks 182 are about 120,000 cps compared to heights of about 50,000 cps for peaks 192. Finally, the peaks 182 are quite similar to one another. In comparison, peaks 192 are not similar and in fact, are quite different especially during the tail periods.

Use of a gas channeling sleeve allows the peaks 182 to be narrower (in peak width, tail length and overall length), to be much larger in peak height, to be more reproducible in terms of areas and shapes, and to be produced more frequently than peaks 192. In addition, the shape of peaks 182 is more consistent and repeatable than peaks 192. Use of the gas channeling sleeve permits a higher throughput of ions through an ion guide, as is indicated by the taller, narrower and more closely spaced peaks 182 in mass spectrum 180 than the peaks 192 in mass spectrum 190.

Optionally, a gas source may be used to provide gas at the ion entry end 110 of the ion guide. Such gas will be drawn through the ion transport space as part of the gas flow 157. Providing such a gas flow may enhance the gas flow 157 and increase the axial drag on ions in the ion transport space, thereby transporting ions from the ion entry end 110 to the ion exit end 112 more effectively.

The gas channeling technique may be used in an ion guide operated at any pressure level. The technique is particularly useful for use with ion guides operated at a pressure of 0.1 Torr or greater, although it may be used with lower pressure ion guides.

Figure 7:
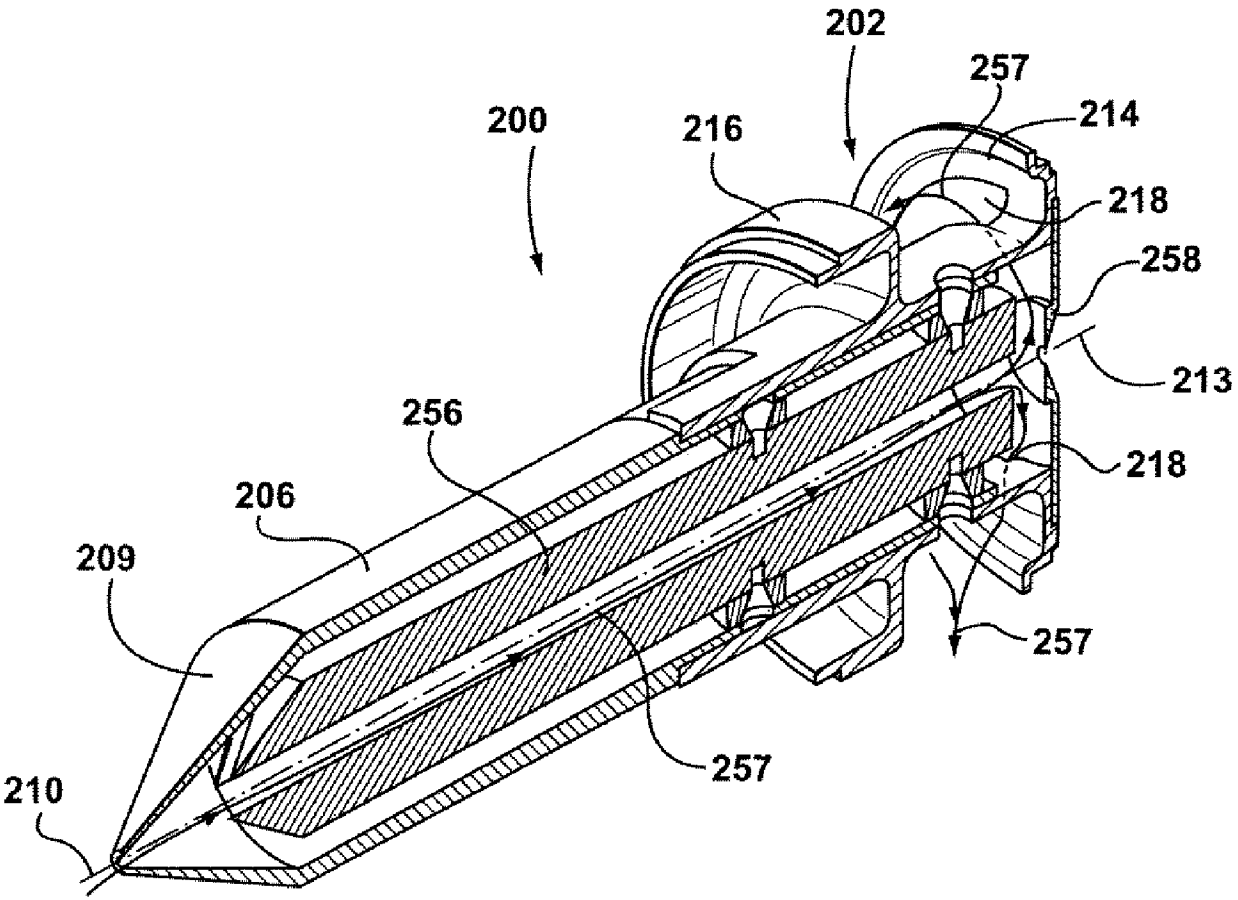
FIG. 7 is a perspective cross-sectional view of a second example ion guide.

Reference is next made to FIG. 7, which illustrates a second examplary ion guide 200. Ion guide 200 includes a sleeve cap 209 mounted to sleeve 206 at the ion entry end of the ion guide. In this example, sleeve cap 209 is in the form of a cone. In other examples of ion guide assemblies according to the invention, the sleeve cap may be of a different shape and may be a flat cap extending across the sleeve 206 at the ion entry end of the ion guide 200.

Ions enter the ion transport space 256 from an ion source. In addition, the gas flow 257 begins at cap aperture 209. Sleeve cap 209 restricts the gas flow into the ion entry end 210, allowing a pressure differential to be created between the ion transport space 256 and the MALDI ionization region (between the MALDI plate and the ion entry end of the ion guide and adjacent the matrix-solution) when a roughing pump (or another suction device) is used to set the pressure in the ion transport space. For example, gas may be bled into the ionization region to allow a higher pressure regime in the ionization region than may exist in the ion transport space 256.

Sleeve cap 209 may also serve to enhance the gas flow through cap aperture 209 by increasing the gas drag near the point of ion ablation adjacent matrix-solution 244. The number of ions entering the ion transport space 256 may be increased by the increased gas drag. The cap may also take the form of a cone located in front of (but not fastened to) the ion guide assembly, separating regions of differential pressure. Under these conditions, gas expands through the cone and into the ion guide inlet, and the sleeve supplements this flow along the entire length of the ion guide.

Figure 8:
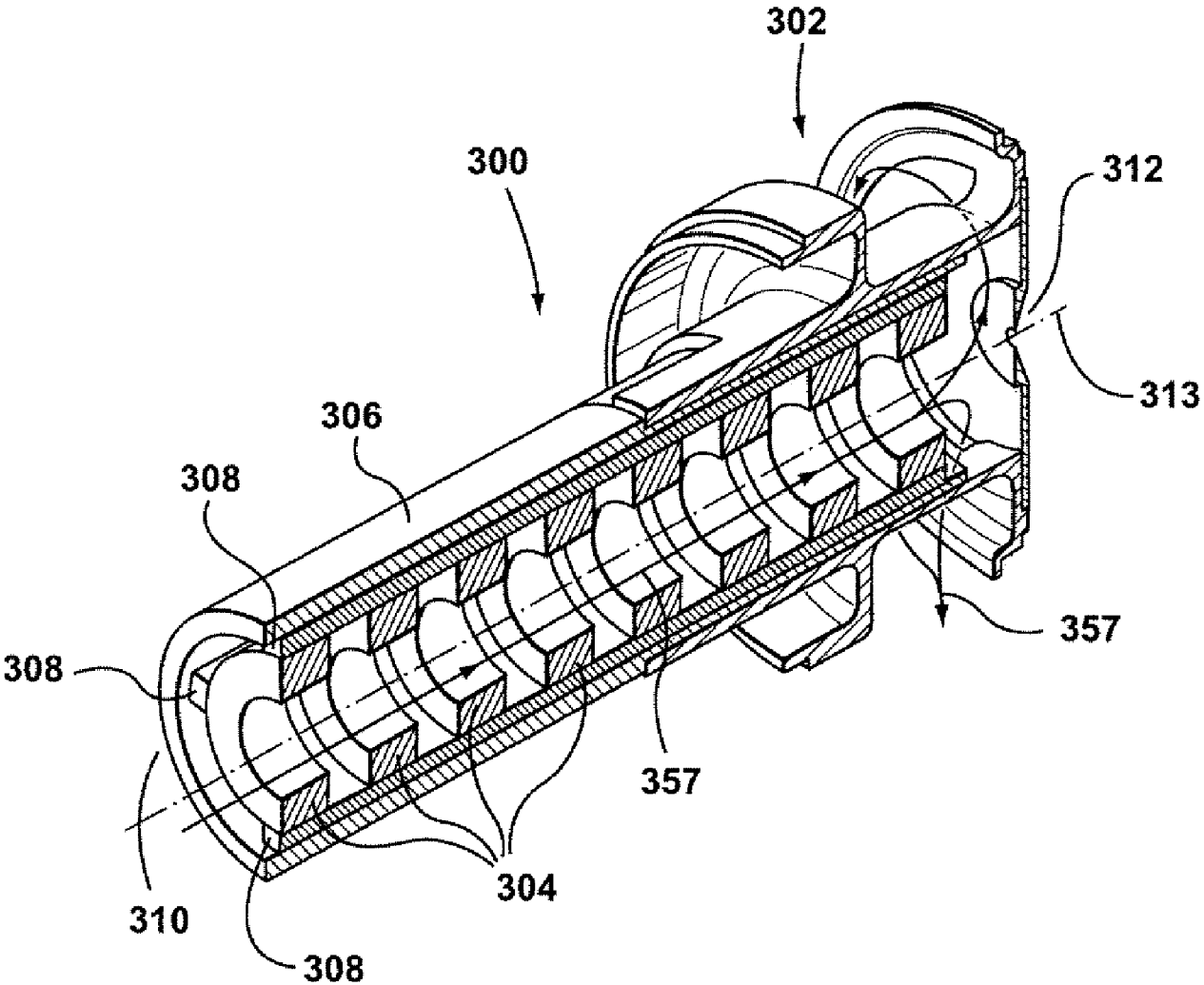
FIG. 8 is a perspective cross-sectional view of a third example ion guide.

Reference is next made to FIG. 8, which illustrates another exemplary ion guide 300. Ion guide 300 includes a plurality of ion focusing rings 304 spaced apart from one another. An RF signal source (not shown) applies a first RF signal to a first group of rings 304 and a second RF signal to a second group of rings 304. In the present example, the rings are placed into the first and second group in alternating order so that each adjacent pair of rings in the first group has a ring from the second group between them, and vice versa. The first and second RF signals are configured to focus ions along the axis 313 of the ion guide. A sleeve 306 is positioned within mounting bracket 302. Insulators 308 are mounted to sleeve 306 and rings 304 are mounted to insulators 308. Insulators 308 may be mounted to sleeve 306 and rings 304 using friction or using a mechanical or adhesive fastener (not shown). Ion guide 300 may be installed in a housing to form an ion guide assembly to which a suction device may be coupled. Ion guide 300 is used in the same manner as ion guide 100 to transport ions from ion entry end 310 to ion exit end 312. Sleeve 306 channels a gas flow 357 generally along axis 313 when the suction device is activated. The rings may have additional DC offsets to further facilitate ion motion in addition to the gas flow.

Figure 9:
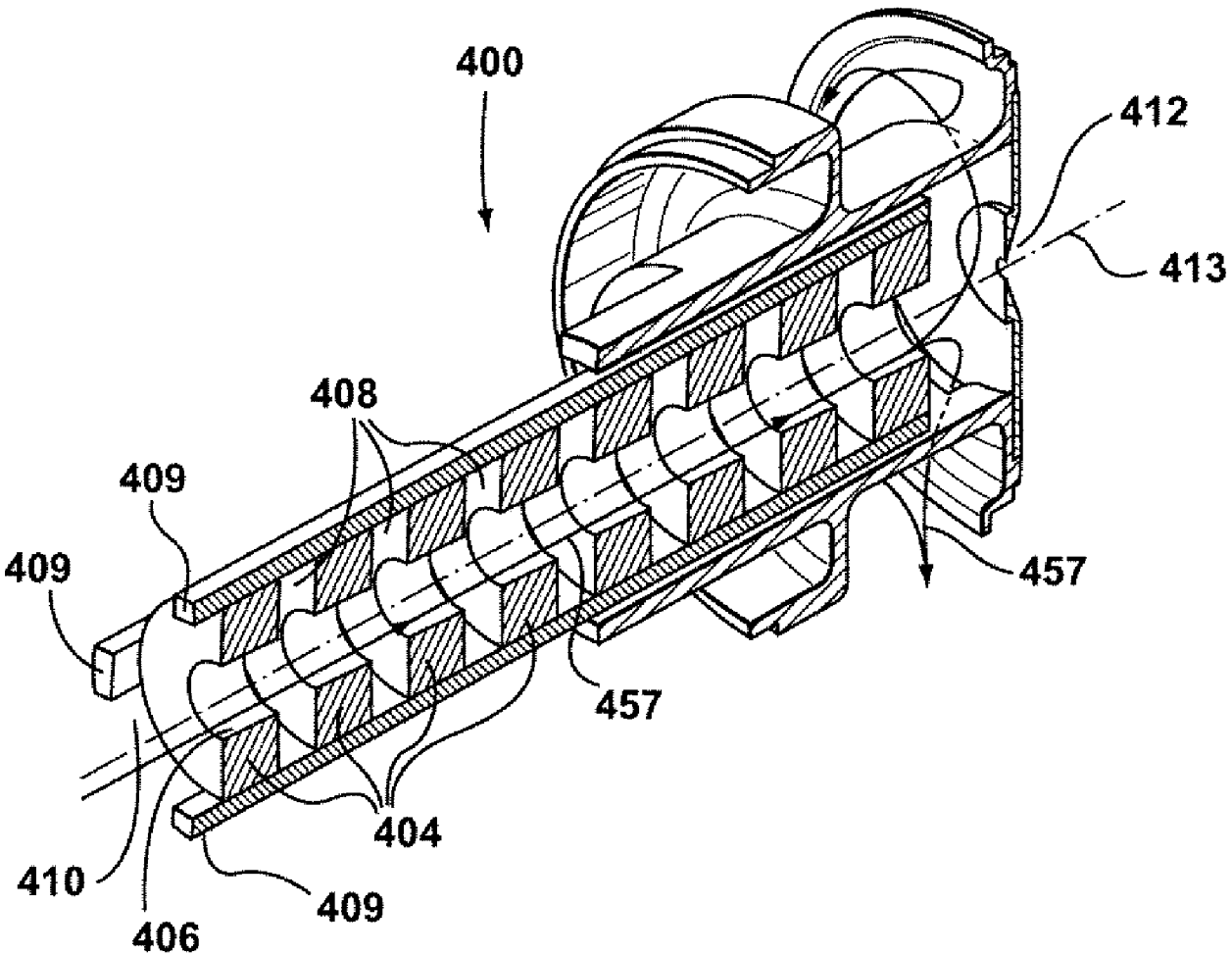
FIG. 9 is perspective cross-sectional view of a fourth example ion guide.

Reference is next made to FIG. 9, which illustrates another exemplary ion guide 400. Like ion guide 300, ion guide 400 uses ion focusing rings 404 to focus ions along the axis of the ion guide. Rings 404 are separated by insulators 408 mounted between and electrically isolating adjacent rings. The rings 404 and insulators 408 are sealed to produce a cylinder that is gas impermeable along its side wall. The rings 404 and insulators 408 are mounted to the mounting bracket using non-conductive plates 409. The gas impermeable side wall functions as a gas channeling sleeve 406 and no separate sleeve is required. Ion guide 400 may be mounted in a housing to form an ion guide. A suction device is used to provide a gas flow 457 along the length of the ion guide 400. The gas flow transports ions from the ion entry end 410 to the ion exit end 412.

Several examples have been described. The specific structure of an ion guide utilizing a gas channeling sleeve may be varied depending on the structure and operation of the device with which the ion guide is to be used.

In other examples similar to ion guide 200, a sleeve cap may be formed integrally with the sleeve 206. Similarly, a sleeve cap may be used in conjunction with sleeve 306 and a sleeve cap could be mounted to the side wall 406 in ion guide 400. Alternatively, ion guides 100, 200, 300, and 400 may be positioned after a gas flow restricting aperture or cone.

The gas flow produced in an ion guide utilizing a gas channeling sleeve augments the space charge repulsion effect or any additional gas flows resulting from gas expansion into the ion guide inlet to enhance the flow of ions through a multipole assembly. The ion transport gas flow may also be used in cooperation with other mechanisms that can enhance or direct ion transport. For example, the use of tilted rods or resistive rods can be used to create a non-constant field along the length of a multipole assembly. The application of RF signals to the rods can also enhance ion transport along the multipole assembly. In such an embodiment, the RF signals applied to the first and second poles may not be of an equal magnitude and 180° out of phase. The use of a gas channeling sleeve is compatible with these and other ion transport structures and techniques.

Ion guides 100 and 200 are described in the context of a quadrupole. A gas channeling sleeve may be used with any multipole assembly that has more than four rods and which may have more than two poles.

The examples described thus far are primarily illustrated in relation to ion sources that do not provide a gas flow within the ion transport space. The present technique is also suitable for use with ion sources that provide ions within a gas flow such as electrospray ion sources. An electrospray ion source injects ions in a gas stream, which transports ions. The gas stream will transport ions along the axis of an ion guide over at least a portion of the length of the ion guide. By generating an additional gas flow using the present invention, the transport of ions from such an ion source may be enhanced.

Various other modifications and variations may be made to these exemplary embodiments without departing from the spirit and scope of the applicant's teachings, which is limited only by the appended claims.

We claim:

1. A method of transporting ions, the method comprising:

(a) providing an ion guide within a single pressure region, the ion guide having an ion entry end and an ion exit end;

(b) providing an ion focusing field within the ion guide;

(c) positioning a gas channeling sleeve about the ion guide; and (d) suctioning gas through the gas channeling sleeve to generate a gas flow along at least part of a length of the ion focusing field, including a region adjacent the ion exit end.

2. The method of claim 1 wherein the ion guide is a multipole ion guide having at least two poles and wherein the ion focusing field is provided by applying radio frequency signals to the poles.

3. The method of claim 2 wherein the poles includes a first pole and a second pole, and wherein the ion focusing field is produced by applying a first RF signal to the first pole and a second RF signal to the second pole wherein the first and second RF signals have an approximately equal magnitude but are 180° out of phase with one another.

4. The method of claim 1 wherein the gas flow is provided at least in part along an axis of the ion guide.

5. The method of claim 1 wherein the ion guide is formed of a plurality of conductive rings separated by interspersed insulators, wherein each insulator is sealed against adjacent rings and wherein the gas flow is generated by suctioning gas through the rings and the insulators.

6. The method of claim 1 wherein the ion guide is comprised of a plurality of rings spaced apart from one another and wherein the gas flow is generated by positioning the gas channeling sleeve about the rings and suctioning gas through the gas channeling sleeve.

7. The method of claim 1 further comprising producing ions from an ion source positioned adjacent an ion entry end of the ion guide and wherein the produced ions are transported from the ion entry end of the ion guide assembly towards an ion exit end of the ion guide by the gas flow.

8. The method of claim 1 further comprising producing ions at an elevated pressure relative to the ion guide and passing the ions through one or more pressure differentiating element prior to entering the ion guide.

9. The method of claim 1 wherein an additional gas flow is generated through the ion entry end of the ion guide.

10. The method of claim 9 wherein the additional gas flow is restricted at the ion entry end.

11. The method of claim 1 wherein the gas flow is generated through the ion entry end of the ion guide.

12. The method of claim 11 wherein the gas flow is restricted at the ion entry end.

13. An ion guide comprising:

(a) a plurality of ion focusing elements positioned about an axis;

(b) an ion entry end and an ion exit end spaced along the axis; and (c) a gas channeling sleeve for channeling a gas flow along at least a portion of the axis, wherein the ion guide is located within a single pressure region.

14. The ion guide of claim 13 wherein the ion focusing elements include a first pole and a second pole, wherein the first pole includes at least two first pole rods and the second pole includes at least two second pole rods, and wherein the gas channeling sleeve is positioned about the first and second pole rods.

15. The ion guide of claim 14 wherein the ion guide has an ion entry end and an ion exit end wherein the gas channeling sleeve extends between at least a portion of the ion entry end and the ion exit end.

16. The ion guide of claim 15 wherein further comprising a sleeve cap mounted to the gas channeling sleeve adjacent the ion entry end and wherein the sleeve cap has a cap aperture to permit ions to enter the ion guide.

17. The ion guide of claim 13 wherein the ion focusing elements include a plurality of rings separated by insulators, wherein the rings and insulators together form the gas channeling sleeve.

18. The ion guide of claim 13 wherein the ion focusing elements include a plurality of rings positioned about the axis and positioned within the gas channeling sleeve.

19. An ion guide assembly having an ion entry end and an ion exit end comprising:

(a) a plurality of ion focusing elements positioned about an axis;

(b) a gas channeling sleeve for channeling a gas flow along at least a portion of the axis; and (c) a suction device for suctioning gas through the gas channeling sleeve, wherein the ion guide assembly is located within a single pressure region.

20. The ion guide of claim 19 further comprising a sleeve cap mounted on the gas channeling sleeve adjacent the ion entry end.

* * * * *